US008082594B2

(12) United States Patent
Autry

(10) Patent No.: US 8,082,594 B2
(45) **Date of Patent: *Dec. 27, 2011**

(54) PROTECTION SYSTEM

(76) Inventor: Marcy S. Autry, Acworth, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/498,203

(22) Filed: Jul. 6, 2009

(65) Prior Publication Data

US 2009/0265827 A1 Oct. 29, 2009

Related U.S. Application Data

(63) Continuation of application No. 12/053,460, filed on Mar. 21, 2008, now Pat. No. 7,555,789.

(51) Int. Cl.
*A41B 13/10* (2006.01)

(52) U.S. Cl. ..... 2/49.1; 2/52

(58) Field of Classification Search ..... 2/49.1–49.5, 2/48, 114, 46, 50, 51, 52, 69, 69.5, 74, 75, 2/80, 83, 88, 111, 104; D2/860–864, 823
See application file for complete search history.

(56) References Cited

U.S. PATENT DOCUMENTS

| | | | | | |
|---|---|---|---|---|---|
| 193,054 | A | * | 7/1877 | Tower | 2/51 |
| 699,238 | A | * | 5/1902 | Reed | 2/49.5 |
| 742,059 | A | * | 10/1903 | Peterson | 2/51 |
| D59,555 | S | * | 11/1921 | Ladd | D2/861 |
| 1,657,868 | A | * | 1/1928 | Segal | 2/52 |
| 1,963,130 | A | * | 6/1934 | Hall | 2/49.1 |
| 2,080,107 | A | * | 5/1937 | Brandstein | 2/50 |
| 2,154,227 | A | * | 4/1939 | Brown | 2/74 |
| 2,299,232 | A | * | 10/1942 | Heyser | 2/49.1 |
| 2,416,609 | A | * | 2/1947 | Brehm | 2/50 |
| 2,451,038 | A | * | 10/1948 | Mink | 2/48 |
| 2,668,294 | A | * | 2/1954 | Gilpin | 2/114 |
| 2,686,914 | A | * | 8/1954 | Weiser | 2/114 |
| 2,803,013 | A | * | 8/1957 | Freiberger | 2/50 |
| 2,973,523 | A | * | 3/1961 | Brainard et al. | 2/46 |
| 3,112,491 | A | * | 12/1963 | Cleveland | 2/90 |
| 4,205,398 | A | * | 6/1980 | Blume | 2/114 |
| 4,304,006 | A | * | 12/1981 | Swart | 2/49.1 |
| 4,660,224 | A | * | 4/1987 | Ashcraft | 2/48 |
| 5,052,055 | A | * | 10/1991 | Mysliwiec | 2/48 |
| D356,204 | S | * | 3/1995 | Derrickson | D2/720 |
| 5,682,609 | A | * | 11/1997 | Ayo | 2/49.2 |
| D389,290 | S | * | 1/1998 | James et al. | D2/861 |
| 6,049,909 | A | * | 4/2000 | Anderson | 2/111 |
| 6,141,798 | A | * | 11/2000 | Manning | 2/49.1 |
| 6,742,189 | B2 | * | 6/2004 | Bennett | 2/49.2 |
| D499,530 | S | * | 12/2004 | Mintz et al. | D2/864 |
| D507,393 | S | * | 7/2005 | Gabrielson | D2/864 |
| 7,278,171 | B1 | * | 10/2007 | Besch | 2/48 |
| 2008/0092263 | A1 | * | 4/2008 | Good et al. | 2/49.1 |

* cited by examiner

*Primary Examiner* — Amy B Vanatta
(74) *Attorney, Agent, or Firm* — Michael L. Greenberg, Esq.; Greenberg & Lieberman, LLC

(57) ABSTRACT

A protection system for the neck, chest, and torso on down to the mid-thigh area as it shields the wearer from a variety of messy situations. One embodiment employs sleeves that cover both arms of a user entirely and end with thin, elastic cuffs or bands at the wrists. In addition, the protective layer features a base that is A-lined and extends to the mid-thigh area. The back of the protective layer remains open from the adjustable closure device down to the bottom.

1 Claim, 5 Drawing Sheets

PROTECTION SYSTEM

CONTINUITY DATA

This is a continuation of application Ser. No. 12/053,460, filed Mar. 21, 2008, now U.S. Pat. No. 7,555,789 issued on Jul. 7, 2009 and priority is claimed hereto.

The present invention is a protection system for a user that relates primarily to a latex-free material comprised of a neckline that fits comfortably over the wearer's neck that is secured by a closure in the back. One embodiment features long covering sleeves ending with thin elastic cuffs, and various additional features associated with the material that ultimately serves to protect the wearer from making a mess onto his or her clothes from the neck down. An additional embodiment performs the protective function without sleeves.

BACKGROUND OF THE INVENTION

Clothing is big business. People spend huge amounts of money and endure shopping malls and other crowded stores to purchase these outfits. And since clothes are generally expected to last, people usually do not want to ruin the look with stains. It should be noted that clothing purchases are not differentiated by age or lifestyle as virtually everyone form the elderly and infirmed to the smallest of infants wear some semblance of clothing outfits. In the case of infants, a number of stores even solely cater to the purchase of clothes for these newborns. For that reason, various forms of bibs have entered the market, nearly always specifically designed for infants in high-chairs.

Many of these bibs consist of some sort of fabric or material that protects their clothing from food. There is no question that infants can make quite a mess while eating, and the idea of the bib is meant to minimize this issue. However, a number of practical and relevant issues evolve with most current bibs. For one thing, they require constant laundering because virtually every time an infant or younger toddler eats, the bib is likely to get messy. So if a child eats a number of meals a day, these bibs would need to be washed as many times, unless the parent is willing to purchase numerous bibs or allow them to remain stained.

Moreover, the mess is not limited to one area of the body. Besides the face, current bibs still permit the mess to gather on the shoulders, arms, lower abdomen region, and lap. And those bibs that do attempt to incorporate sleeves often are either difficult to put on or floppy and not conducive to the movements of an infant as can be the case with those bibs featuring an open back sleeve. An additional aspect of current bibs, especially the ones that are meant to protect the arms and neck, is that they almost always are meant for infants. They often do not take into account the inherent dignities, size and other factors related to feeding for those adults who may suffer paralysis or other ailment that hinders their eating ability. In addition, these bibs are not proper or designed for other older children who may be engaged in crafts or other messy projects. As with other bibs, the same issues apply in this case in that nearly every time these types of bibs are used, they must be cleaned.

Therefore, there is a need for a garment that is disposable in nature but also designed to comfortably protect all of the clothing and skin of people of all ages during such messy situations as feeding. While certainly pertaining to infants, this need does apply to those aforementioned people ranging from toddler, to school age and adult. A garment such as this would greatly benefit those people who do not wish or find it convenient to wash bibs and clothing on a consistent basis.

Instead, a garment is needed that can be simply, easily and cost-effectively placed over regular clothes during such messy moments, and then promptly discarded afterward. In addition, this garment is needed to be able to cover the arms and lap in a comfortable but efficient manner, as well as extend to the thigh areas for maximum protection. As described below, nothing else compares with the unique aspects of the present invention.

U.S. Pat. No. 4,811,428 issued to Waldman on Mar. 14, 1989, is a disposable bib for children that relies on hooks and loops, as well as a pocket to collect food droppings. Unlike the present invention, this item is designed specifically for children and focuses itself on a complex flame retardant material rather than the less complicated, more practical elements of the present invention. The present invention also includes the A-lined base which better assists the protection aspect without the need for additional material.

U.S. Pat. No. 5,036,547 issued to Silas on Aug. 6, 1991, is a bib designed specifically for babies that implements a sleeve system that does not require the baby's arm to slide through. Unlike the present invention, this item is not disposable and takes only babies into account with its design and intentions, especially related to the sleeve with an open back. The present invention also includes the A-lined base, which better assists the protection aspect without the need for additional material.

U.S. Pat. No. 6,128,781 issued to Spindler on Oct. 10, 2000, is an apparatus that couples a bib with a tray in order to minimize the mess associated with feeding for those who are not capable of ordinary feeding movements. Unlike the present invention, this item does not utilize sleeves or any other item that can serve to protect the arms from mess, while instead relying on the bib and tray combination. Moreover, unlike the present invention, this item must be cleaned and is not intended to be disposable. The present invention also includes the A-lined base, which better assists the protection aspect without the need for additional material.

U.S. Pat. No. 6,237,150 issued to Lucas on May 29, 2001, is a disposable bib for infants and toddlers that relies on a pocket-catching mechanism to collect food falling from the child's mouth. Unlike the present invention, this item is designed for small children and focuses on the pocket rather than the design as a whole. In addition, unlike the present invention, this item does not offer coverage for the arms. The present invention also includes the A-lined base, which better assists the protection aspect without the need for additional material.

A need has been established for a protection system that is both disposable in nature and also designed to protect the clothing or skin of all types of people—not just small children—during such messy moments as feeding or even crafts. A garment that is comfortable and easily worn, while at the same time offers protection for the shoulders and lap in order to collect all potential dangers to clothing is needed. Therefore, the present invention satisfies those needs while at the same time being disposable, meaning that only the face and hands need to be cleaned instead of the arms, clothing or even the garment itself.

SUMMARY OF THE INVENTION

The present invention is a protection system that is comprised of a durable, latex-free material that is disposable in nature and open in the back. The neckline fits comfortably around the neck similar to a collarless shirt. An adjustable closure device, which can be made of VELCRO™, or other adjustable attaching device is attached to the shoulder area and is easily secured behind the shoulders. An additional embodiment includes long sleeves, although the preferred embodiment of the present invention is sleeveless. The sleeves in the additional embodiment cover both arms entirely and end with thin, elastic cuffs or bands at the wrists. In addition, the present invention features a base that is A-lined and extends to the mid-thigh area. The back of the present invention remains open from the adjustable closure device down to the bottom.

DETAILED DESCRIPTION OF THE PREFERRED EMBODIMENT

Figure 1:
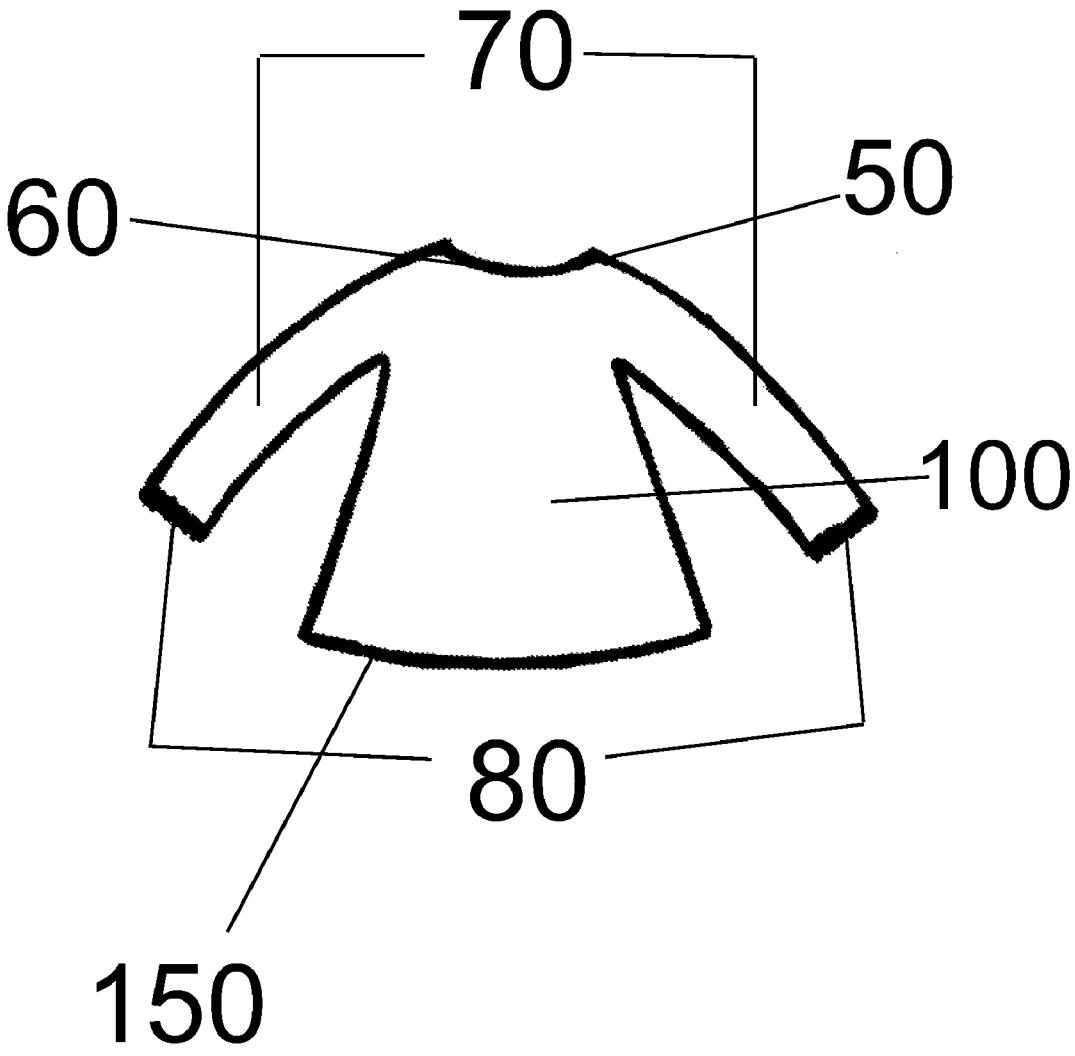
FIG. 1 is a front view of the present invention with sleeves.
Figure 3:
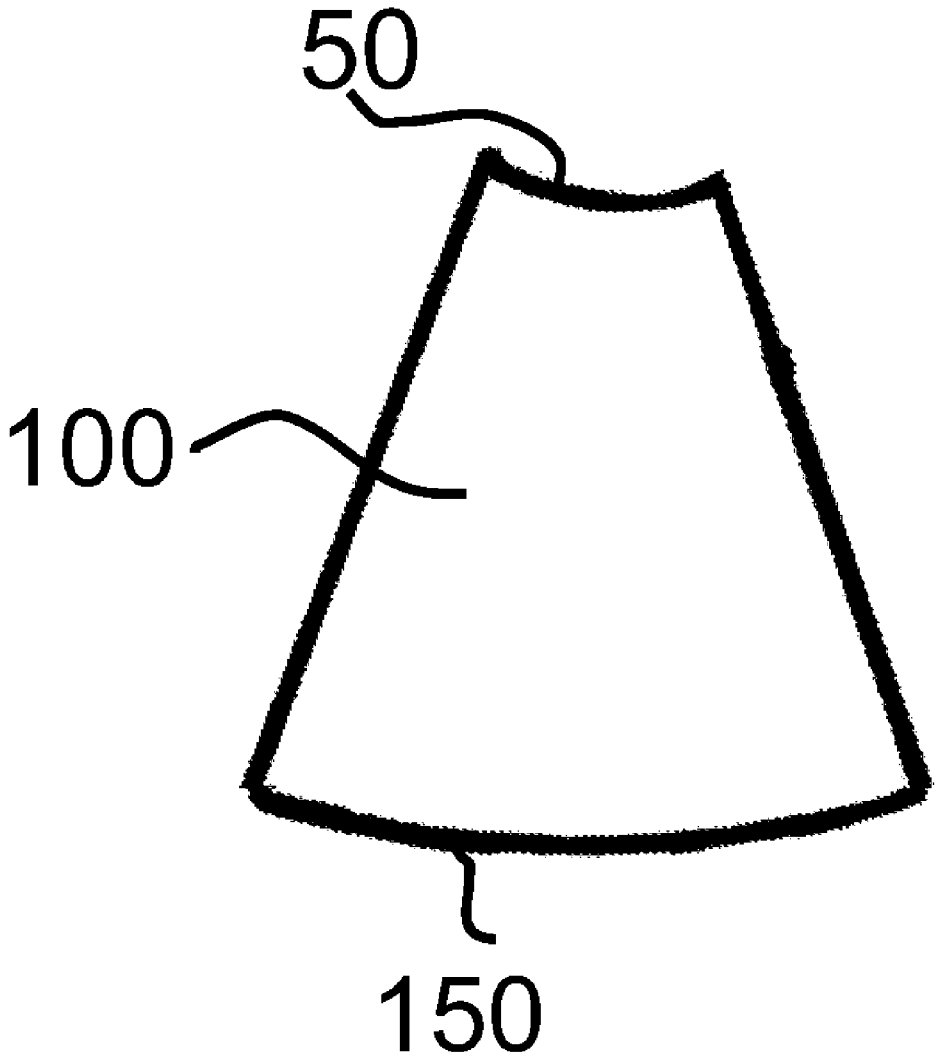
FIG. 3 is the front view of the sleeveless embodiment of the present invention.
Figure 4:
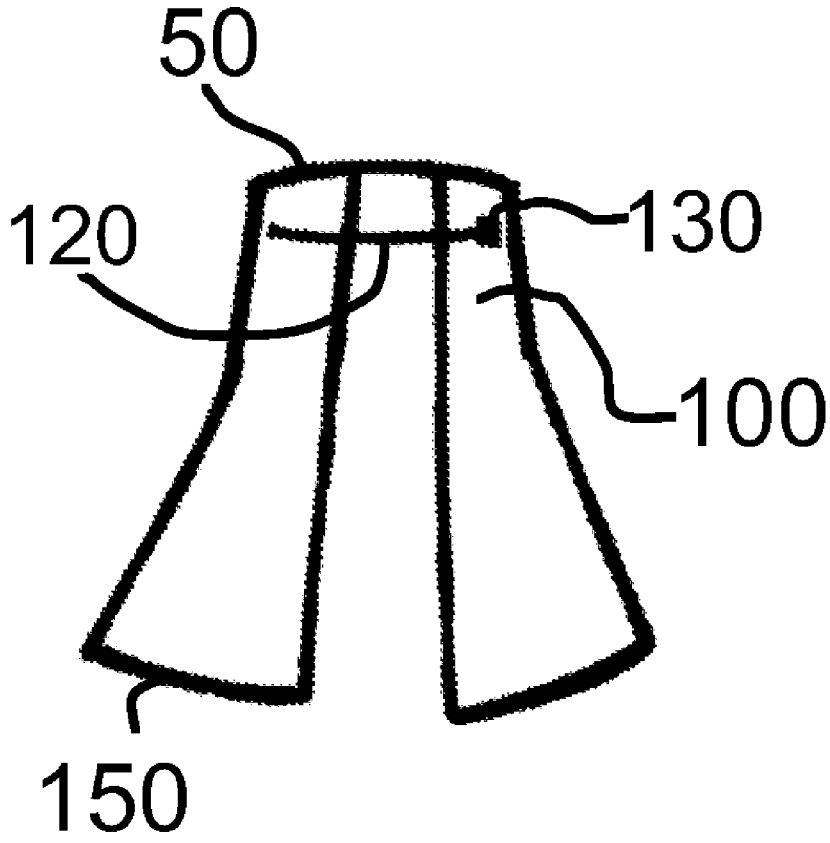
FIG. 4 is the back view of the sleeveless embodiment of the present invention.

The present invention is a protection system for a user that is disposable and serves to protect the wearer from mess while engaged in such activity as eating and crafts. In addition, the present invention is designed so that a helper, also referred to as a user, may simply place the present invention onto a wearer. In FIG. 1, we see the front portion of the present invention. The body (100) is preferably latex-free material and makes up much of the rest of the overall garment element of the present invention. The exceptions in relation to FIG. 1 are the adjustable back closing device (120) and elastic bands (80), which are connected via any conventional means to body (100) and are therefore disposable as well. The two sleeves (70) in FIG. 1 are integrated into the body (100) and are equal in length, width, etc. It is important to note that the two sleeves (70) are merely an embodiment of the present invention. FIG. 3 and FIG. 4 highlight the additional embodiment pertaining to a sleeveless embodiment. In relation to the embodiment of FIG. 1, the elastic bands (80) are attached to the end of the sleeves (70) where the sleeves (70) terminate near the user's hands. At the bottom of the present invention, we see the base (150) that is A-lined and intended to extend the present invention to the mid-thigh level. In fact, the user may cover the mid-thigh area and torso with the A-lined base (150). By exposing and flaring out the base (150) of the garment, the user can pull the base (150) to cover the sides of the torso.

Figure 2:
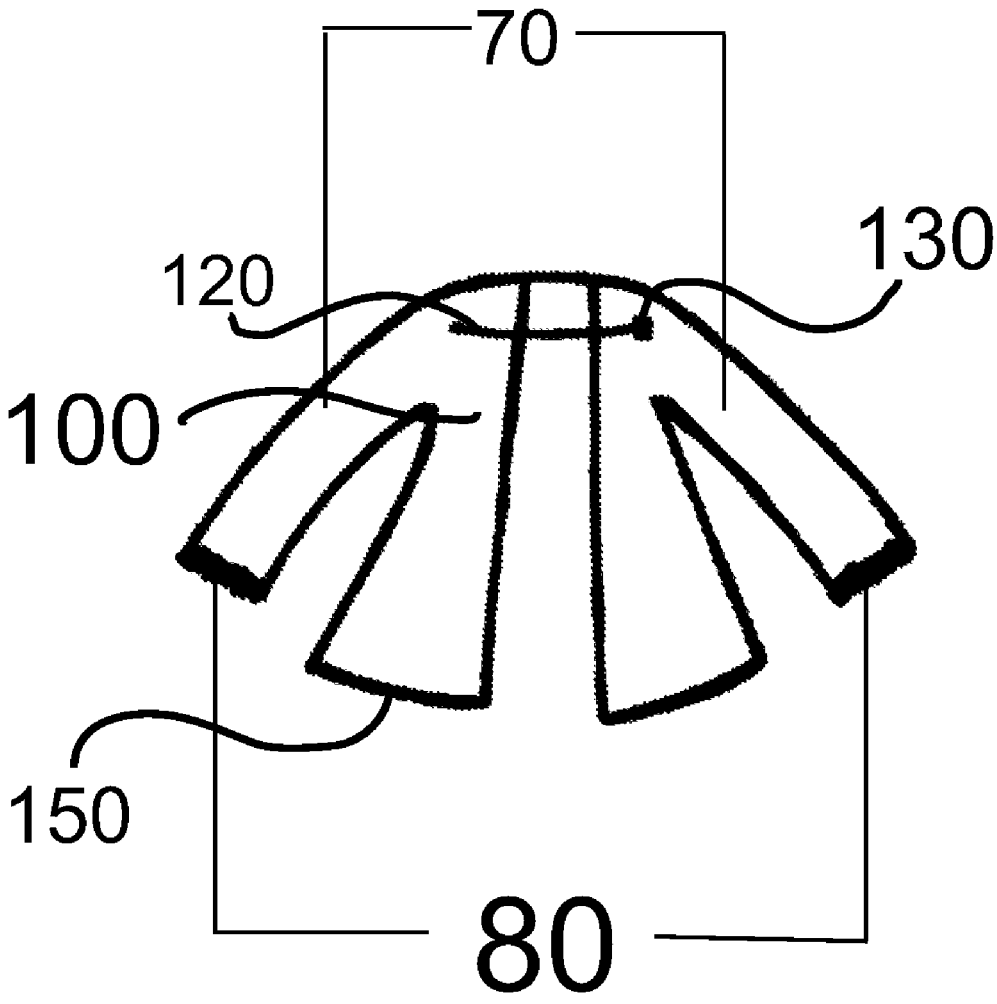
FIG. 2 is a back view of the present invention with sleeves.

In FIG. 2, we see the back portion of the present invention. We see that the area of the body (100) that would normally cover the wearer's back is open. An adjustable back closing device (120)—which can be VELCRO™ or another sticky-tape type element—is attached to the present invention near where the shoulder blades may be. The adjustable closing device physically connects with the corresponding connector (130) on the opposite shoulder blade as seen in FIG. 2. The corresponding connector (130) can be made of the opposite, matching VELCRO™ or complimentary sticky element used to physically attach the adjustable back closing device (120) to the corresponding connector (130). However, the adjustable back closing device (120) and the corresponding connector (130) can also consist of ties or virtually any other connection element that maintains the character of the present invention and its disposable elements. As seen in FIG. 2, as the adjustable back closing device (120) is a long sticky-type element that reaches around the width of the wearer to connect with its corresponding connector (120) element on the other side. While the back of the body (100) is open, the sleeves (70) are not. Instead, the sleeves (70) and elastic bands (80) of this embodiment are the same as seen in FIG. 1.

Figure 5:
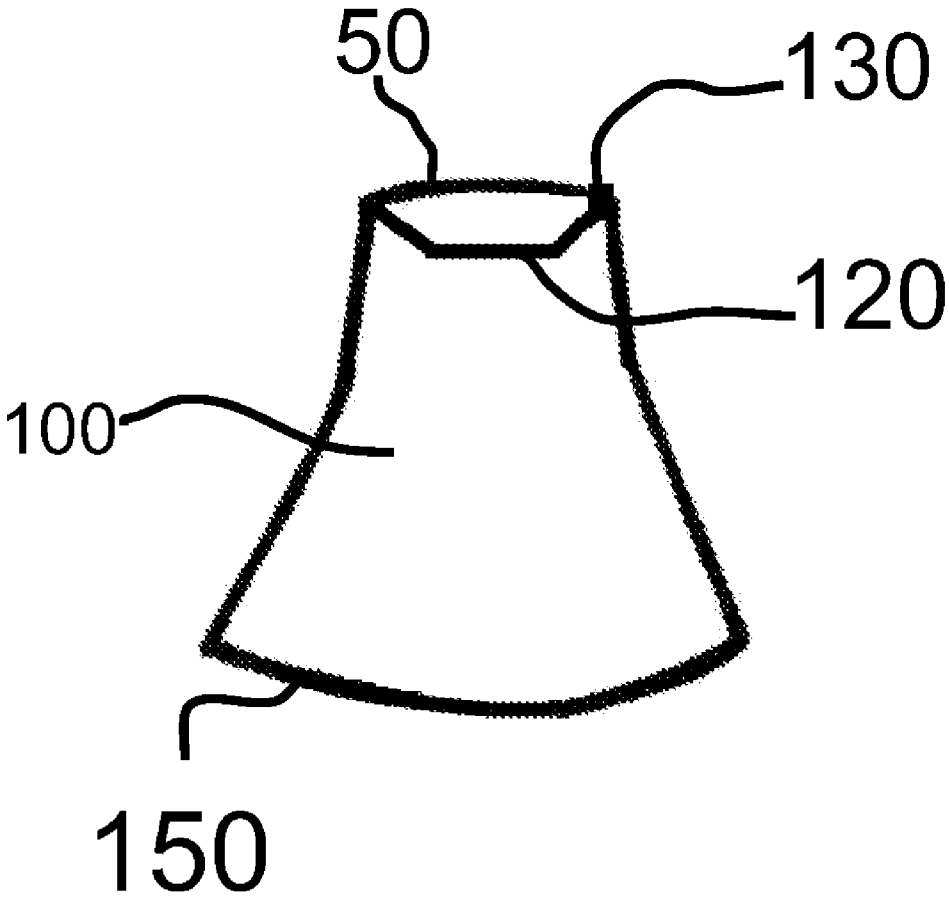
FIG. 5 is a back view of the embodiment of the present invention without a back.

FIG. 3 is a front view of the embodiment of the present invention that does not include sleeves (70). FIG. 4 is a rear view of the embodiment that does not include sleeves (70). The present invention in this sleeveless embodiment is used and functions in much the same way as described in relation to the embodiment containing sleeves (70). FIG. 5 also is a rear view of the present invention. However, the view in FIG. 5 demonstrates an embodiment where there is no backing. This means that the helper allows the wearer, or user, to wear the present invention by covering the user from the neckline (50) of the user to a mid-thigh area of the user with a top front portion of the garment, also known as the body (100), and a base (150) of the garment. The user or his or her helper also assists by attaching the adjustable back closing device (120) of the garment to a corresponding connector (130) of the garment similar to the way described in the other embodiments. The user also may cover a left side of the user and the right side of the user with a side portion of the garment.

The present invention is relatively simple to put on and remove. First, a helper would typically place the present invention toward the front of the wearer in relation to the wearer's body. The helper would then proceed to line the neckline (50) up to the wearer's neck and simply use the adjustable back closing device (120) to comfortably and safely attach the present invention to the wearer. The adjustable back closing device (120) is adaptable enough to compliment varying wearer sizes or other physical attributes. The adjustable back closing device ultimately adjusts until connecting with the corresponding connector (130).

Once the adjustable back closing device (120) is secured around the shoulder-blade portion of the wearer, the helper can aid the wearer by placing the wearer's arms into the sleeves (70) in regard to that embodiment. The disposable, latex free material of the body (100)—the latex free material preferably also makes up the sleeves (70)—is flexible enough to make this task relatively simple. In the embodiment relating to sleeves (70), after the wearer's arms are placed inside each respective sleeve (70), the helper can easily pull the wearer's hands through the two elastic bands (80). Once the wearer's hands are outside of the present invention, the elastic bands (80) operate comfortably and gently (not hurting the wearer) while at the same time serve to better connect the present invention to the wearer. This also creates less motion and flimsiness that otherwise could arise without the use of the elastic bands (80) in relation to the sleeves (70). It also should be noted that the arms could be placed into the sleeves (70) before securing the present invention through the use of the adjustable back closing device (120).

Meanwhile, the base (150) is A-lined and extends the present invention to the mid-thigh area. This means that the present invention protects and covers the wearer from the neckline (50) on down to the base (150) at mid-thigh, which would effectively cover all relevant clothing areas based on a typical meal setting and positioning. As mentioned above, the sleeves (70) also are completely protected in the front and back as they are secured and free from unnecessary movement with the use of the elastic bands (80).

Once the wearer is finished eating or engaged in another type of messy activity, a reverse process commences. The helper can aid the wearer in unfastening the adjustable back closing device (120) from its corresponding connector (130) and then can easily remove the wearer's hands and arms back out of the sleeves (70) in reverse while folding the present invention into itself which keeps the mess within the present invention. Then, no matter how messy the present invention is, the helper can simply throw it away.

As described above, the present invention is a protection system for a user. It is to be understood that the user will likely require the assistance of the helper, but the term user is intended to refer to either the user or the helper. The user attaches the adjustable back closing device of the garment to the corresponding connector of the garment. In this manner, the user is covered from the neckline of the user to the mid-thigh area of the user with the top front portion of the garment and the flared base (150) of the garment. After the user is finished with the garment, the user may dispose of the garment. Again, the user exposes and flares out the base (150) of the garment in order to cover the mid-thigh area of the user. In regard to the embodiment with the sleeves (70), the user pulls the sleeves (70) of the garment down the arms of the user and secures the sleeves (70) at the wrists of the user via elastic bands (80). Meanwhile, the user secures the adjustable back closing device of the garment to the corresponding connector of the garment behind the neck of the user. Since an embodiment of the present invention does not have a back portion of the garment, a user covers a left side of the user and the right side of the user with a side portion of the garment. The user will cover a portion of the back of the user if there is a back portion of the garment in additional embodiments of the present invention. In addition, a shoulder portion of the garment covers the shoulders of the user.

Primarily, the present invention is a necessary and useful system that protects clothing during messy situations from the neck and arms on down. At the same time, the present invention is easy to handle and is disposable, meaning that only the face and hands of the wearer should need cleaning as opposed to the garment or other articles of clothing. In addition, the present invention satisfies a need to society, as it is not limited in scope or design to just infants. Instead, the present invention is meant for a person of any age that is engaged in inherently messy activities. Examples of this (but certainly not limited to) are adults who have limited motor skills, children engaged in messy craft or projects and children in the early stages of feeding. At the same time, cleaning is substantially lessened as the present invention is disposable. It is to be understood that the present invention is not limited to the sole embodiment described above, but encompasses any and all embodiments within its scope.

I claim:

1. A protection method for a user, comprising:

attaching an adjustable back closing device of a garment to a corresponding connector of the garment such that the adjustable back closing device is the only means of fastening the garment, the adjustable back closing device positioned at the top of the garment;

covering the user from the neckline of the user to a mid-thigh area of the user with a top front portion of the garment in combination with a base of the garment, the base being A-lined;

maintaining spaced edges under the adjustable back closing device of the garment; and disposing of the garment after use.

* * * * *